United States Patent [19]

Ahlefeld

[11] Patent Number: 5,069,259

[45] **Date of Patent: * Dec. 3, 1991**

[54] BOAT ENGINE WINTERIZING DEVICE

[76] Inventor: Marvin A. Ahlefeld, 2005 Rolling Ridge, Bethany, Okla. 73008

[ * ] Notice: The portion of the term of this patent subsequent to Jan. 22, 2008 has been disclaimed.

[21] Appl. No.: 608,835

[22] Filed: Nov. 5, 1990

Related U.S. Application Data

[63] Continuation-in-part of Ser. No. 492,846, Mar. 13, 1990, Pat. No. 4,986,319.

[51] Int. Cl.[5] ..... B65B 3/04; B63B 17/00

[52] U.S. Cl. ..... 141/98; 141/59; 141/363; 248/225.31; 248/689; 184/105.1; 184/1.5

[58] Field of Search ..... 141/98, 1, 59, 387, 141/363; 248/689, 225.31, 231.2, 231.4; 114/270; 184/105.1, 1.5; 138/32-35

[56] References Cited

U.S. PATENT DOCUMENTS

| | | | |
|---|---|---|---|
| 2,243,517 | 5/1941 | Adamson | 248/231.2 |
| 2,414,078 | 1/1947 | Wetzel | 248/225.31 |
| 3,967,697 | 7/1976 | Guenther | 184/1.5 |
| 4,271,874 | 6/1981 | Brady | 141/1 |
| 4,378,034 | 3/1983 | Albertson | 141/1 |
| 4,432,525 | 2/1984 | Duvall | 248/231.4 |
| 4,681,290 | 6/1987 | Crosbie | 248/225.31 |
| 4,695,088 | 9/1987 | Jensen | 184/106 |
| 4,757,990 | 7/1988 | Dosch | 248/231.2 |
| 4,793,275 | 12/1988 | Usher | 114/270 |
| 4,807,674 | 2/1989 | Sweet | 141/59 |
| 4,946,005 | 8/1990 | Levine | 184/105.1 X |
| 4,986,319 | 1/1991 | Ahlefeld . | |
| 4,986,777 | 1/1991 | Preston | 184/1.5 X |

*Primary Examiner*—Henry J. Recla
*Assistant Examiner*—Casey Jacyna
*Attorney, Agent, or Firm*—Laney, Dougherty, Hessin & Beavers

[57] ABSTRACT

A device for winterizing boats by replacement of coolant water in the engine thereof with antifreeze solution, such device including a pair of elongated substantially parallel rods having their opposite ends interconnected by clamping elements operable to vary the distance separating the rods. Each rod carries a sealing head which can be sealingly positioned over the water intake on opposite sides of the outdrive of an engine to be winterized. The sealing heads can be independently adjusted in their positions along the elongated rods. One of the sealing heads carries a fitting by means of which an antifreeze solution can be connected to the sealing head to allow the solution to be passed through the sealing head, through intake ports and into the engine to replace coolant water in the engine which is displaced through discharge ports of the engine.

2 Claims, 2 Drawing Sheets

BOAT ENGINE WINTERIZING DEVICE

RELATED APPLICATION

This application is a continuation-in-part of my U.S. Pat. application Ser. No. 07/492,846, filed on Mar. 13, 1990, entitled "BOAT ENGINE WINTERIZING DEVICE"now U.S. Pat. No. 4,986,319.

BACKGROUND OF THE INVENTION

1. Field Of The Invention

This invention relates to devices for winterizing boat engines which draw fresh water into the cooling system of the engine when the engine is in operation, and which require the draining of the engine and replacement of the cooling water in the engine in order to prepare the boat for winter.

2. Brief Description Of The Prior Art

Many recreational boats used on fresh water streams today include engines which are cooled by fresh water drawn from the body of water in which the boat is operated. The fresh water is drawn into and circulated within the cooling system of the engine. It is difficult to drain such engines when the boating season has ended and at the onset of winter so as to completely remove the water therefrom to an extent such that any freezing which occurs will not damage the engine. Moreover, even when substantially all the water is drained, the interior of the cooling system tends to become rusted due to the moisture and air which remain in the cooling system.

In U.S. Pat. No. 4,271,874, a system is disclosed for flushing the engine cooling system with an antifreeze solution. In this system, liquid is introduced into the cooling system either of an inboard boat engine having a stern outdrive unit, or of an outboard engine, at a time when both the boat and the engine are out of the water. This is accomplished by placing the tank-shaped device of the invention completely around the lower portion of the drive unit where the water intake to the engine is located, and filling it with the antifreeze solution to be introduced into the cooling system, doing so while concurrently running the motor. The device by which the solution is charged to the engine is a contoured container which is adapted to be attached to, and fit about, the lower portion of an outdrive unit, or an outboard engine. When the container is used for winterizing the motor, it holds a sufficient amount of antifreeze so that mixing of this rather concentrated antifreeze chemical with the water in the cooling system will develop adequate protection against freezing of the mixture placed in the system as mixing occurs during powered recirculation of the coolant.

BRIEF DESCRIPTION OF THE PRESENT INVENTION

The present invention provides a device for winterizing the water cooled engines or motors used on boats operated in a fresh water environment. The winterizing device of the invention can be very quickly placed in position to allow the engine to be winterized in a matter of a very few minutes, and requires no large investment in complicated machinery, nor does it require the use of bulky parts.

Broadly described, the winterizing device of the invention includes a pair of elongated rods which are extended on opposite sides of the engine while it is yet mounted on the transom of a boat alongside the location of the engine where the intake ports are located. These rods can be adjusted in their proximity to each other by means of one or more clamping subassemblies which engage and interconnect opposite ends of the rods to each other, and adjust the distance which separates the rods. Intermediate the ends of each of the rods are a pair of sealing head subassemblies, one of which is carried slidably on each rod. Each sealing head subassembly includes a slide block which enables the sealing head subassembly to slide axially along the rod upon which it is mounted, a set screw for setting or locking the slide block in a selected position, and a resilient sealing ring carried on the slide block, and of sufficient size to fit over, and seal around, the intake ports of the motor. One of the sealing head assemblies further includes a nipple or fitting to which a hose can be attached for delivering antifreeze solution to the interior of the sealing ring, and thus to the engine intake ports in order to displace fresh cooling water from the engine, and replace it with the antifreeze solution.

The purpose of this winterizing device is to allow an antifreeze solution to be easily injected into the engine to eliminate any freezing during the winter. By merely hand tightening a pair of screws it is possible to eliminate possible leakage at the lower outdrive where the antifreeze is supplied to the engine. Moreover, with this winterizing device it is not necessary to remove the propeller from the outdrive in order to place the winterizing device in place for utilization.

One important object of the invention is to provide a device which can be economically manufactured, and can be used by a novice with little formal training or experience in winterizing boats upon receiving a few simple instructions.

Another object of the invention is to provide a boat winterizing device by which a low freezing point solution can be quickly introduced to the cooling fluid passageways in the cooling system of the engine used to power the boat.

A further object of the invention is to provide a winterizing device which is characterized in having a trouble free operating life, and which, should a part of the device malfunction, is constructed to allow that particular part to be quickly and easily replaced without the need to replace the entire winterizing device.

Additional objects and advantages of the invention will become apparent as the following detailed description of the invention is read in conjunction with the accompanying drawings which illustrate a preferred embodiment of the invention.

GENERAL DESCRIPTION OF THE DRAWINGS

DETAILED DESCRIPTION OF A PREFERRED EMBODIMENT OF THE INVENTION

Figure 1:
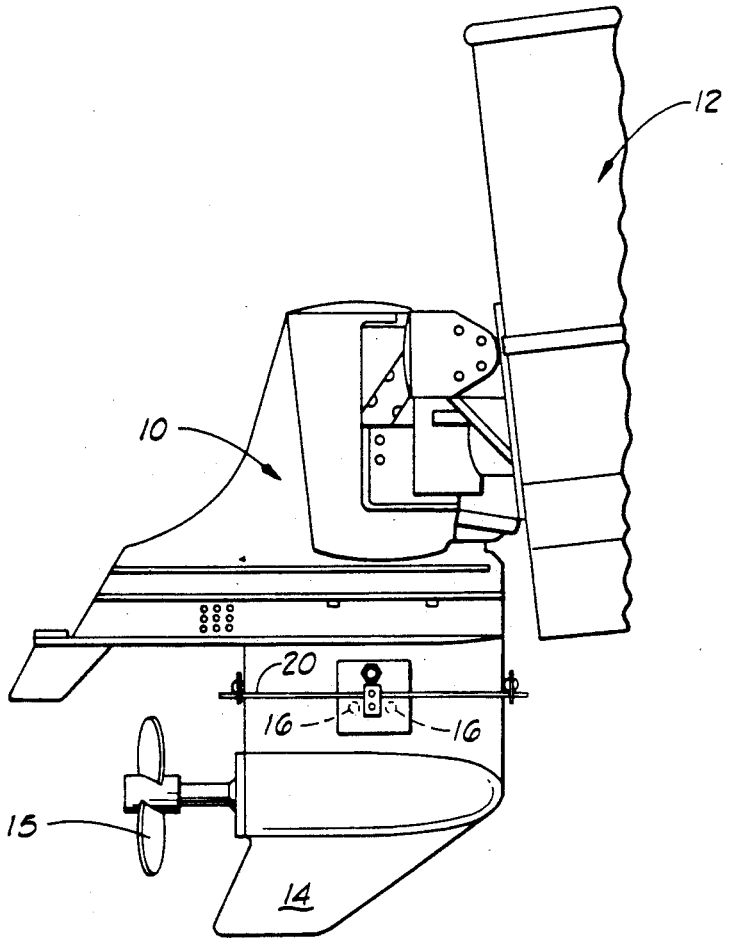
FIG. 1 is a view in elevation illustrating an inboard engine with the outdrive mounted on the transom of a boat and having the winterizing device of the present invention mounted thereon for use in winterizing the engine.

Referring initially to FIG. 1, an outdrive designated generally by reference numeral 10, is shown mounted to the transom of a boat 12. The outdrive has a rudder 14 and a propeller 15 of conventional construction, and further includes a plurality of water intake ports 16 (shown in dashed lines) through which fresh water is drawn to cool the engine during its operation. The water intake ports 16 communicate with cooling passageways (not visible) inside the engine, and the water which is drawn through these ports is ultimately discharged through suitable water discharge ports (not shown). For the purpose of winterizing a boat by replacement of the fresh water normally circulated through the cooling passageways after entry through the intake ports 16, the winterizing device 17 of the invention functions to permit fresh water in the engine to be displaced by antifreeze solution which can then be retained in the engine throughout the winter and will not freeze.

Figure 2:
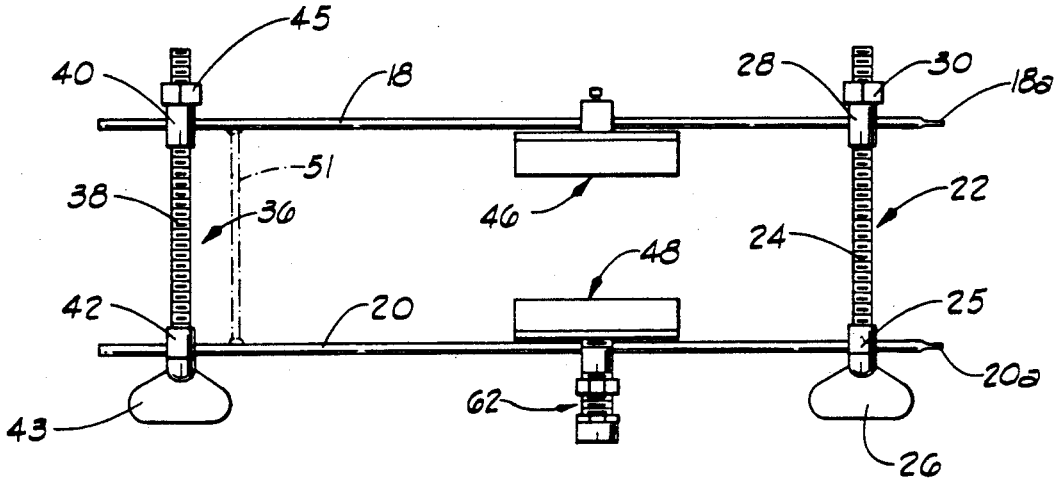
FIG. 2 illustrates, in plan view, the winterizing device of the invention as it appears when it is removed from the engine of the boat.
Figure 4:
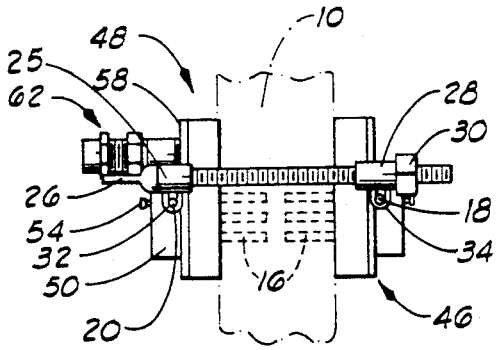
FIG. 4 is an end elevation view of the winterizing device of the invention showing an outdrive upon which the winterizing device is mounted to cover the intake ports for the engine in the manner illustrated in full lines in FIG. 1.

The winterizing device 17 of the invention is depicted in plan view in FIG. 2 of the drawings. The winterizing device includes a pair of elongated rods 18 and 20. The elongated rods 18 and 20 extend substantially parallel to each other and are of sufficient length to extend past the forward side and rear side of the outdrive, as illustrated in FIG. 1. The forward ends of the rods 18 and 20 are flattened or flared as shown at 18*a* and 20*a*. Near their forward ends, the rods 18 and 20 are interconnected by a forward clamp subassembly denominated generally by reference numeral 22. The forward clamp subassembly 22 includes an elongated shaft 24 which is threaded over at least a portion of its length, and which has a flared or winged head 26 secured to one end thereof. The shaft passes through a tubular sleeve 25 adjacent the flared head 26 and through a tubular sleeve 28 adjacent the other end thereof. A threaded tightening nut 30 is secured to the sleeve 28 and is provided to permit this sleeve to be forced axially along the threaded shaft 24, thus moving this sleeve closer to the sleeve 25. The sleeve 25 carries an eye 32, as shown in FIG. 4, and the sleeve 28 carries an eye 34. The eyes 32 and 34 are sized to permit the elongated rods 20 and 18 to be movably passed therethrough, and thus the clamp subassembly 22 can be moved axially along the rods 18 and 20 if this is desirable to fit the winterizing device to engine outdrives of varying size. The flattened ends 18*a* and 20*a* of the rods 18 and 20 prevent the clamp subassembly 22 from sliding off the rods 18 and 20. By the adjustability afforded by the winged head 26 and the threaded nut 30, the rods 18 and 20 can be moved closer to each other, or they can be displaced further apart, as these rods follow the relative movement of the sleeves 25 and 28 positioned around the shaft.

At the opposite ends of the elongated rods 18 and 20, a second clamping subassembly 36 is preferably provided. The clamping subassembly 36 may be constructed substantially identically to the clamping subassembly 22, and thus may include an elongated shaft 38 which is threaded over at least a major portion of its length, and passes through a pair of spaced sleeves 40 and 42. A winged head 43 is secured to the shaft 38. The sleeve 40 does not engage the shaft 38, but is free to move therealong as an internally threaded nut 45, which is secured to the sleeve 40, is threaded along the shaft. Both the sleeve 40 and the sleeve 42 carry depending eyes 49 through which the elongated rods 18 and 20 pass, respectively. The clamping subassembly 36 can be moved axially along the rods 18 and 20 as desired.

In an alternative construction, the nuts 30 and 45 can be eliminated, and instead, the sleeves 28 and 40 can be internally threaded to afford threaded engagement with the threaded shafts 38 and 24.

In yet another embodiment of the invention, the rods 18 and 20 may be rigidly or unadjustably interconnected at their rear ends directly to each other or by any suitable cross member. In such case, only the forward adjustable clamping subassembly is used for drawing only the forward ends of the rods toward each other. The device will be operative when only the clamping assembly at the forward ends of the rods 18 and 20 is used to pull these opposed ends of the rods toward each other, and in this way cause the sealing head assemblies hereinafter described to be pressed into a sealing relationship with the opposite sides of the outdrive. Such a rigid interconnection used in one type of alternate embodiment is illustrated in FIG. 2 in dashed lines and is there denominated by reference numeral 51. It is a simple structure and includes only the single cross bar 51 which is welded at its opposite ends to the parallel rods 18 and 20.

It is also possible to form the rods 18 and 20 as an integral or single piece rod which has been bent through a bight or connecting web at a location toward the rear of the outdrive so that the opposed rod parts are interconnected and have a certain amount of inherent resiliency or spring which permits them to be pulled toward each other by the forward adjustable clamping subassembly, which is the only adjustable clamping subassembly needed and used in such form of the invention.

From the description of the winterizing device as thus far advanced, it will be perceived that the elongated rods 18 and 20 can be adjusted in their positions relative to each other. In general, they remain substantially parallel, but the distance which separates them is variable in order to adjust the winterizing device so as to permit it to be usefully employed on outdrives of various sizes and configuration. As shown in FIG. 1, the rods 18 and 20 are generally positioned on the opposite sides of the outdrive, and are located so as to extend opposite intake ports 16 formed at this location in the engine.

Slidably mounted on each of the elongated rods 18 and 20 is a sealing head subassembly. Thus, a sealing head subassembly designated generally by reference numeral 46 is slidingly mounted on the elongated rod 18, and a sealing head subassembly 48 is slidingly mounted on the elongated rod 20.

Figure 3:
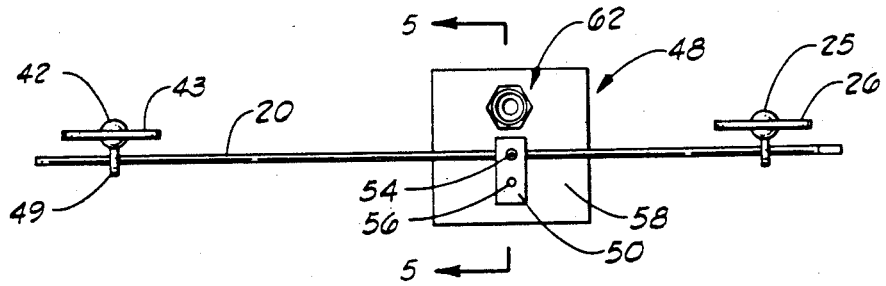
FIG. 3 is a side elevation view of the winterizing device of the invention.

As shown in FIG. 3, each of the elongated rods 18 and 20 passes through a slide block 50 forming a part of the respective sealing head subassembly 46 or 48. Each slide block 50 has a bore 52 formed therethrough to slidingly receive the respective elongated rod 18 or 20. The positions of the respective sealing head subassemblies 46 and 48 along the respective elongated rods 18 and 20 is determined by the setting fixed by a set screw 54 threaded through each of the blocks S and against the respective elongated rod to prevent further movement of each of the blocks 50 relative to its respective rod. Since the sliding blocks 50 are each secured to the remainder of the respective sealing head subassemblies 46 and 48 with which they are associated, fixation of the sliding block on its respective elongated rod 18 and 20 is tanamount to fixation of the respective head subassembly 46 or 48 at that location.

Figure 5:
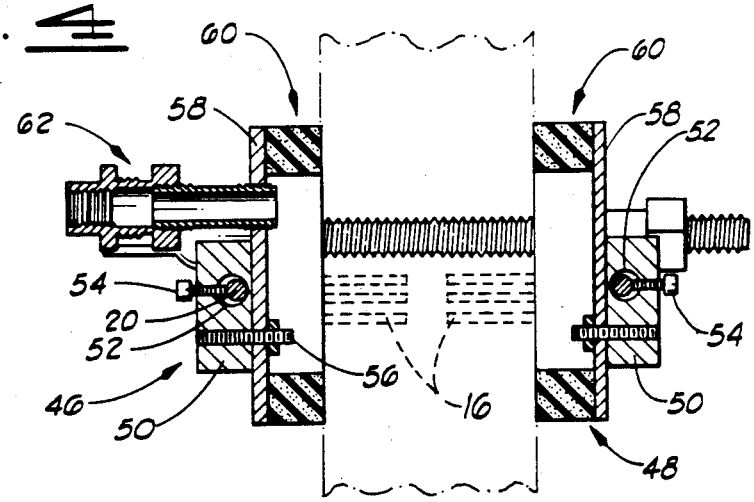
FIG. 5 is a sectional view taken along line 5—5 of FIG. 3.

Each of the slide blocks 50 is secured by a suitable fastener 56 to a generally rectangular metallic plate 58. At the opposite side of each of the metallic plates 58 from the slide blocks 50 carried on the outer side thereof, each metallic plate is secured to a generally rectangular block 60 of resilient sealing material, such as sponge rubber, or a suitable synthetic resin or the like. These rectangular blocks 60, which will hereinafter be referred to as sealing rings, define a sufficiently large void within the interior of the sealing ring so that the sealing rings are able to surround the intake ports 16 formed in the lower side of the outdrive 10. This coverage of the intake ports 16 is schematically illustrated in FIG. 5 of the drawings, where the outdrive 10 and the intake ports 16 entering the side thereof are illustrated in dashed lines.

In order to permit an antifreeze solution to be introduced to the interior of the engine via the intake ports 16, the sealing head subassembly 46 is provided with an extended nipple or fitting 62. A flexible tubing or hose may be connected to this nipple to allow an antifreeze solution from a suitable source, such as a tank, bucket or the like, to be fed through the hose to the nipple 62, and from the nipple 62, to the space confined within the sealing ring 60. When the container holding the antifreeze solution is filled, and the winterizing device is attached to the outdrive 10, the engine is then started and the water pump will cause the antifreeze solution to enter the engine, thereby displacing water with a solution that will freeze only at a very low temperatue, thus protecting the engine against normal winter temperatures.

The antifreeze-containing tank or bucket can be located at various places and can be in various shapes and forms. In a particularly convenient method of winterizing the engine, a tank, bucket, catch basin or other container is located below the outdrive in a position to catch all liquid discharged from the engine as it is turned over in the course of replacing the coolant. The tank or bucket located below the outdrive, just as in other methods of usage, contains the antifreeze liquid which the engine water pump circulates through the engine. As the engine is run, the antifreeze is drawn into the engine via the fitting 62, circulated therethrough and discharged from the outdrive at the usual points of discharge. The mixture of antifreeze and water from the engine falls down into the bucket or catch basin, and as circulation continues, the water continues to dilute the antifreeze until a certain freezing temperature is reached which is characteristic of the mixture of antifreeze and water in the catch basin as well as in the engine. When this freezing temperature is satisfactorily low, circulation is discontinued. The engine is now winterized. The mixture of antifreeze and water in the catch basin can be used for other antifreezing applications, such as in internal combustion engines of automobiles or other boat engines.

Once the antifreeze solution has replaced or thoroughly diluted the water in the engine enough that the freezing point of fluid in the engine is reduced below the lowest temperature likely to be experienced during the winter, the winterizing device can be removed from the engine. Alternatively, the winterizing device can be left in place on the engine if such should be desired. This will offer the advantage of having the winterizing device in place in the event that it is desired to replace the antifreeze solution in the spring when sufficiently warm weather has returned.

It will be perceived that in the use of the winterizing device of the invention, the adjustability of the first and second clamp subassemblies 22 and 36, and the spacing of the elongated rods 18 and 20 as a result of this adjustability, permits the device to be used on various sizes of engines. As the clamp subassemblies are adjusted to draw the rods 18 and 20 closer to each other, the resilient material of the sealing rings 60 forming a part of each of the sealing head subassemblies 46 and 48 becomes more highly compressed and seals more tightly against the side of the outdrive and around the intake ports 16 therein.

From the foregoing description of the invention, it will be perceived that the present invention provides a relatively inexpensive, highly useful winterizing device for use in winterizing motorboats. Various changes and innovations can be made in the sructure which has been illustrated and described without departure from the basic principles of the invention. Changes of this type are deemed to be circumscribed by the spirit and scope of the invention, except as the same may be necessarily limited by the appended claims, or reasonable equivalents thereof.

What is claimed is:

1. A device for winterizing boat engines by replacing at least a portion of the engine coolant with an antifreeze solution, such device comprising:

a pair of spaced, elongated rods having first, opposed end portions, and having second end portions, said rods being spaced from each other over a major portion of their lengths;

an adjustable clamp subassembly interconnecting said first, opposed end portions of the rods and adjustable to move said first, opposed end portions of the rods toward and away from each other;

means interconnecting the second end portions of said rods;

a first sealing head subassembly mounted on one of said rods for axial movement therealong, said first sealing head subassembly including:

a first slide block having an opening therethrough and slidably receiving said one rod;

a first resilient sealing ring carried on said first slide block and sealingly engageable with the boat outdrive at a location surrounding and enclosing the water intake ports thereto at a time when the first slide block is positioned opposite said water intake ports;

a fitting connected to said first sealing ring and having an opening into the interior thereof for connection to a flexible tubular member for introducing a solution containing an antifreeze component to said water intake ports via said first sealing ring; and a second sealing head subassembly movably mounted on the other of said elongated rods for axial movement therealong, said second sealing head subassembly including:

a second slide block having an opening therethrough and slidably receiving said second rod; and a second resilient sealing ring carried on said second slide block and engageable with the boat outdrive at a location on the opposite side thereof from said water intake ports.

2. A device for winterizing boat engines as defined in claim 1 and further characterized as including a second fitting connected to said second sealing ring on said second sealing head subassembly and having an opening into the interior thereof for receiving solution containing antifreeze component as it is discharged from said outdrive connection in a closed circuit for recirculating antifreeze solution into a container beneath said outdrive and into the water intake ports of said engine for cycling through said engine multiple times to selectively adjust the freezing point of the liquid in said engine.

* * * * *